United States Patent [19]

Kirby

[11] Patent Number: 4,479,685

[45] Date of Patent: Oct. 30, 1984

[54] FLEXIBLE MAGNETIC ELECTRICAL CONNECTOR AND CABLE INCORPORATING THAT CONNECTOR

[75] Inventor: Robert A. Kirby, Houston, Tex.

[73] Assignee: Exxon Production Research Co., Houston, Tex.

[21] Appl. No.: 505,660

[22] Filed: Jun. 20, 1983

[51] Int. Cl.[3] ..... H01R 11/30; H01R 25/00

[52] U.S. Cl. ..... 339/12 R; 339/49 B; 339/59 M; 339/94 M; 339/104; 339/108 R; 339/151 C; 339/184 M; 367/20; 367/153

[58] Field of Search ..... 339/12 R, 48, 49 B, 339/94 R, 94 M, 151 C, 108 R, 184 M, 184 R, 104, 59 R, 59 M; 285/9 M; 367/14, 15, 20, 153, 154, 156, 177; 403/DIG. 1

[56] References Cited

U.S. PATENT DOCUMENTS

| | | | |
|---|---|---|---|
| 3,812,455 | 5/1974 | Pearson | 339/94 R X |
| 4,045,107 | 8/1977 | Sutherland | 339/49 B X |
| 4,118,090 | 10/1978 | Delmei | 339/12 R |
| 4,166,663 | 9/1979 | Walker et al. | 339/49 B |
| 4,195,894 | 4/1980 | Kotski | 339/59 R X |
| 4,204,188 | 5/1980 | Weichart et al. | 339/15 X |
| 4,260,211 | 4/1981 | Mollere | 339/91 B |
| 4,317,185 | 2/1982 | Thigpen et al. | 339/104 X |
| 4,398,781 | 8/1983 | Dan | 339/94 M |

*Primary Examiner*—Joseph H. McGlynn
*Assistant Examiner*—Steven C. Bishop
*Attorney, Agent, or Firm*—E. Thomas Wheelock; Keith A. Bell

[57] ABSTRACT

This invention is an electrical connector held together by flexible magnetic substrates which also form the support for the connector's electrical contacts. The connector has many uses but is especially suitable for the connection between sections of hydrophone streamer cables.

18 Claims, 6 Drawing Figures

FLEXIBLE MAGNETIC ELECTRICAL CONNECTOR AND CABLE INCORPORATING THAT CONNECTOR

OBJECT OF THE INVENTION

This invention is a flexible electrical connector comprising a number of flexible magnets and contacts. The invention also involves a cable using the connector. The cable is especially suitable for use as a marine seismic cable.

BACKGROUND OF THE INVENTION

The exploration of offshore areas for oil and gas is performed almost exclusively with boats towing one or more of a variety of seismic sources and a large number of hydrophones near the surface of the water. Generally, the seismic sources towed behind the boat emit a sharp pulse which travels down through the water, through the seafloor, into the subseafloor region, and reflects off the interface between two geologic layers of differing densities. The reflected pulse then retraces a similar course and is detected by the hydrophones towed behind the seismic boat.

The hydrophones are typically included in a long streamer cable. The cable may be made up of a number of sections, each filled with oil for proper buoyance and containing a number of hydrophones. Modern cables may be two miles or more in length and contain 4,000 hydrophones. A long cable with a great number of hydrophones provides better resolution of the shape of subsurface geologic features than does a shorter streamer with a smaller number of geophones and often does so with less background noise.

As mentioned above, the cable may be made up of a large number of sections. In this way, if the cable is damaged, e.g., by shark bite, it can be pulled onto the boat until the damaged section is brought aboard, the section unplugged, a new section installed and the cable redeployed in the water. Repairs to the damaged cable may be undertaken without substantial interruption of the exploration activity.

One of the greatest sources of unreliability in a marine seismic cable lies with the electrical connectors used to join adjacent sections of cable. It is not uncommon that a cable will have ten fifty-pin connectors at each of its ends. These connectors are located in a boot which may be up to six feet in length. The connectors typically have small delicate pins and sockets which are subject to mismating. Mismating the two connector halves tends to bend or break the small pins. The large number of mating pins requires special tools to overcome the high friction resistance in separating the halves. The boots may be rigid, in contrast to the pliable nature of the section body, to protect the integrity of the sockets. The junction between the pliable cable sections and the rigid boots, therefore, is susceptible to separation or tearing. The cables and connectors described in U.S. Pat. No. 4,204,188 to Weichart et al, issued May 20, 1980, and U.S. Pat. No. 4,260,211 to Mollere, issued Apr. 7, 1981, are typical of this design. A similar device having a pivoted junction between cable sections is disclosed in U.S. Pat. No. 3,350,678 to McLord, issued Oct. 31, 1967.

As noted above, an aspect of the instant invention is the use of flexible magnetic substrate as part of a flexible electrical connector having near-flush contacts imbedded therein.

Other connectors using flush contacts are known. See U.S. Pat. No. 2,234,982 to Ross, issued Mar. 18, 1941 and U.S. Pat. No. 3,080,544 to Statt et al, issued Mar. 5, 1963. U.S. Pat. No. 3,731,258 to Spicer, issued May 1, 1973, discloses both flush contacts and a flexible rubber substrate. None of Ross, Stratt et al, or Spicer, however, disclose a flexible magnetic substrate.

SUMMARY OF THE INVENTION

This invention centers around a flexible magnetic electrical connector having a wide variety of uses. The invention also includes a cable incorporating the flexible electric magnetic connector and a boot suitable for protecting the electrical connector if it is used between cable sections.

The connector itself is made up of at least two mating portions which are made up of flexible, nonconductive, magnetic substrate portions. The flexible material of construction appears, to the observer, to be a thin but dense section of rubber. The included magnetic particles, in the material available commercially, are alternately polarized in paths through the material. Each substrate has a number of stubby contact surfaces slightly elevated from the face of the substrate adapted to meet in face to face contact when the substrates are assembled. The contact surfaces are placed on the substrates in positions such that rows of opposite polarities on the substrates are in contact when the connector is assembled.

Index pins are installed in the substrate to ensure proper alignment of contact surfaces.

The flexible magnetic substrates need not be merely mated in a matching pattern of contact surfaces; the substrates may form the junction point of, e.g., a wiring harness where a number of different wiring sections meet at a common connector. In such a case, a number of smaller substrates would connect to a single large substrate.

It may be advantageous in some circumstances to plate the contact surfaces with a material which is not susceptible to corrosion, such as gold. Since the usual wiping action performed by a male/female plug does not occur on the instant invention, other methods of wiping, such as by twisting during assembly, may be desirable.

One particularly suitable use for the invention connector disclosed herein is as the connector between sections of marine seismic cable. As was discussed above, connectors previously used in such service have been hard to separate and prone to bent pins due to mismating during assembly. Since the inventive connector has no pins, these problems are obviated.

Also disclosed is a boot assembly especially suitable for use with the magnetic connector which has an outer housing which can be slid completely out of the area of the connector. In this way the magnetic connector can be grasped with ease during disassembly.

A seismic cable adapted for using the boot assembly is a portion of the inventive concept.

DESCRIPTION OF THE PREFERRED EMBODIMENTS

Figure 1:
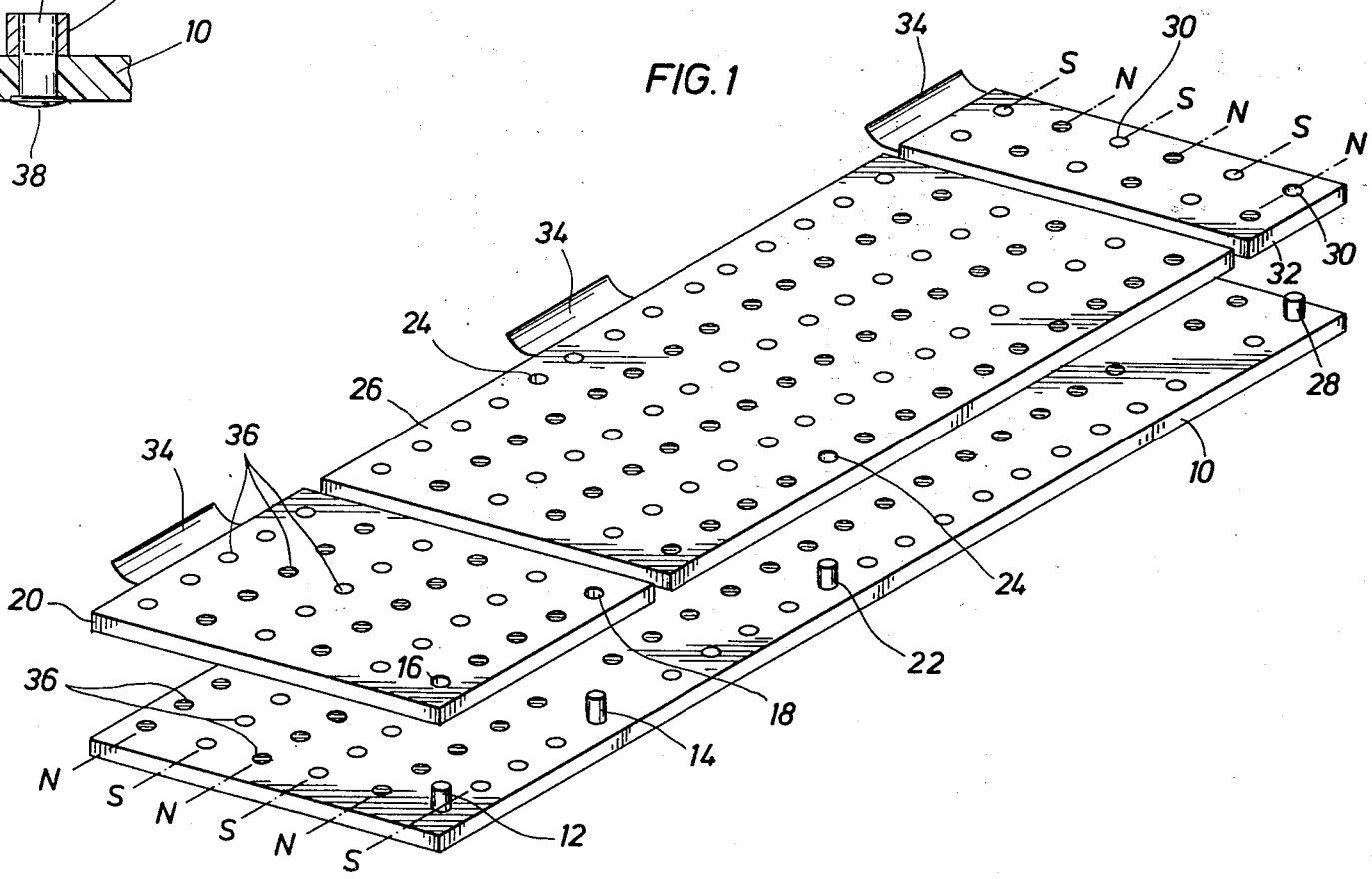
FIG. 1 shows a perspective view of a connector, without attached wires, made according to the invention.

One configuration of the inventive electrical connector is shown in FIG. 1. The connector depicted there is shown without attached wires for the purpose of simplicity of explanation. The variation shown in the figure is complex in that it utilizes four separate flexible, magnetic substrates, i.e., first substrate 10, small substrate 32, medium substrate 20, and large substrate 26. The first substrate 10 has a number of index pins located therein. For instance, pins 12 and 14 are embedded in substrate 10 and engage matching index holes 16 and 18 in medium substrate 20. Similar mating index pins 22 and index holes 24 are shown in conjunction with large substrate 26. Similarly, pins 28 and index holes 30 are shown in conjunction with the small substrate 32. Each of substrates 20, 26, and 32 are shown to have a tab 34 attached to facilitate easy removal from substrate 10.

Figure 1A:
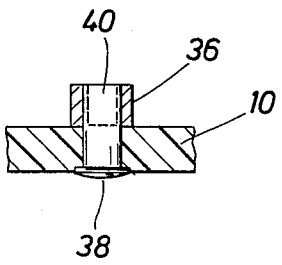
FIG. 1A shows a cutaway side view of a desirable variation of a contact insert suitable for placement in the connector of FIG. 1.

Each of the substrates has mounted therein a number of inserts which serve as contacts. These contacts are shown at 36 both in FIG. 1 and, in cross section, in FIG. 1A. Insert 36 desirably has contact face 38 and a wire receiving end 40. Contact face 38 may be slightly rounded and extends slightly above the face of substrate 10. Wire receiving end 40 is shown to be a hollow cylinder which may be used to accept one or more soldered wires. The wire receiving end may also be of other known designs such as the spade end, loop end, or screw receptacle. The contact face 38 need not be rounded but may be of such shape as would provide a shallow engagement. It is contemplated that the contact insert 36 or its contact face 38 be plated with a corrosion resistant metal such as gold if the atmosphere of use requires such an expedient. The contact inserts may be of a ferromagnetic material such as iron so as to enhance the magnetic attraction between the substrates and the inserts. The inserts may be independently magnetic.

The substrates, such as 10, 20, 26, and 32, desirably are made of a rubberized, magnetic, flexible material having the tradename PLASTIFORM manufactured by the Minnesota Mining and Manufacturing Company, but it is not necessary to do so. This proprietary material typically comes with an alternating north-south orientation of the the metallic magnetic particles in the surrounding polymeric matrix. This alternating orientation is depicted by the north-south symbols at the ends of substrate 10 and substrate 32 in FIG. 1. If this material is chosen for use, it is necessary that the constructor of the inventive connector position the index pins, for instance, 12 and 14, and index holes, 16 and 18, and the various contact inserts 36 within particular substrates so that, when two substrates are indexed and in contact, the south orientations in one substrate are adjacent the north orientations in the other substrate. Such a configuration is shown in FIG. 1. It should be apparent from the drawing that the various inserts 36 are placed within opposite substrates so that two contact faces 38 are in contact.

It is not necessary that there be a one to one conformance between the number of contact inserts in adjacent substrates. It is contemplated that, for instance, should it be found necessary to direct a number of wire leads to a single circuit point such as an electrical ground, a single substrate with a number of contact inserts may be placed directly onto a single conductive substrate.

As mentioned above, there is no wiping action in this connector tending to keep the contacts clean. Consequently, in some services it may be necessary to modify the index pins so that during assembly one substrate of the connector is twisted in relation to the other to perform wiping movement between a number of contact faces 38.

Similarly, although indexing pins and matching indexing holes are the preferred method of assuring a match between appropriate contact inserts on adjacent substrates, other indexing means are of course contemplated. For instance, the edge of adjacent substrates may be fitted into slots on a receptacle mounted in a particular location as in the fire wall of an automobile or airplane. A single indexing device having a shape which may be oriented at only one direction with respect to a mating portion may be installed on a substrate. A wall may be built up on one substrate which may match the outside shape of one or more mating substrates, much in a way a child's puzzle fits together.

Figure 2:
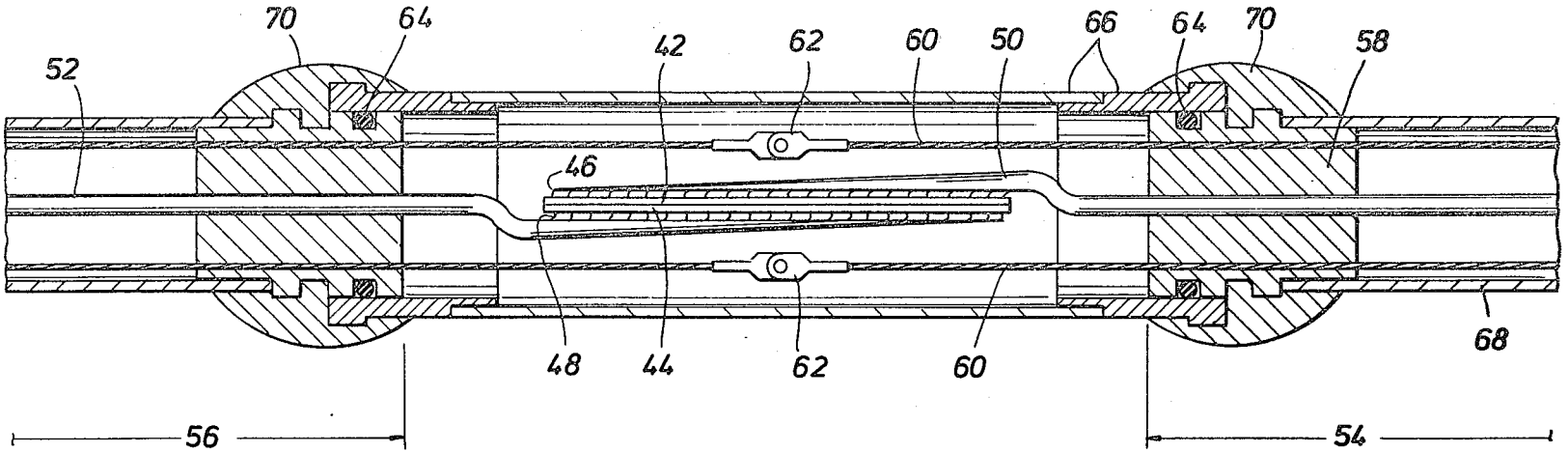
FIG. 2 shows a partial cutaway side view of the junction between two sections of seismic cable incorporating the inventive connector and protective boot.
Figure 3C:
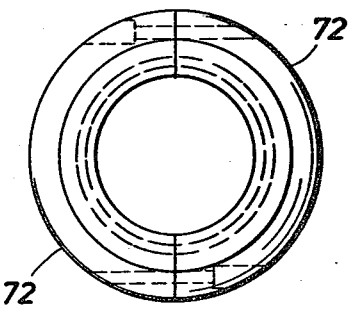
FIG. 3C is a end view of the assembled split ring keeper of FIGS. 3A and 3B.
Figure 3B:
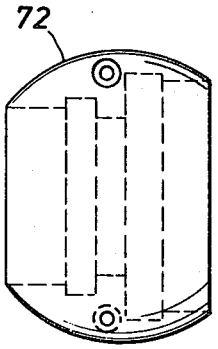
FIGS. 3A and 3B are top and bottom views of one of the split ring keeper halves used on the boot shown in FIG. 2.
Figure 3A:
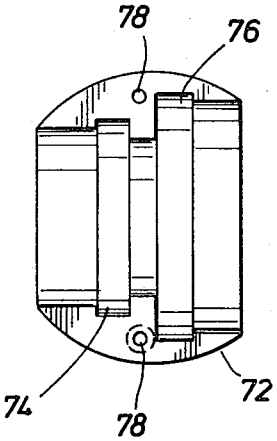

FIG. 2 shows one desirable use for the inventive connector described with regard to FIG. 1. The two substrates 42 and 44 are held in relative proximity by the magnetic forces discussed above. They are not in complete contact since each of the substrate desirably has contact faces (not shown) holding the two substrates slightly apart. Each of the contacts is connected to a wire, for instance 46 and 48. The accumulation of wires is bundled from each substrate 42, 44 to make a cable 50 and 52 respectively. In this variation, each substrate, wire, and cable, is a portion of an attached geophone section, shown generally as 54 and 56. For the purposes of illustration, speaking of the section 54 on the right end of FIG. 2, cable 50 passes through cable bulkhead 58 and onto hydrophones located farther down the section. The hydrophones form no portion of this invention, are well known in the art, and are therefore not described in any great detail. The wire bundle 50 is embedded in cable bulkhead 58. No liquid passes through bulkhead 58. Cable bulkhead 58 also has one or more stress members 60 embedded therein. The stress members are made up of strong stress-carrying materials such as wire rope and should be easily disconnected at connection 62. The stress members 60 pass all the way through the hydrophone section, e.g., 54, to its other end where they may make similar connections with the next hydrophone cable section. The outside of cable bulkhead 58 carries a sealing means 64, such as an O-ring, or other suitable seal design. The outside of cable bulkhead 58 is of such a size that is slips readily inside boot assembly 66 and yet is snug against its inside through the sealing means 64. Cable bulkhead 58 is also firmly attached to the pliable skin 68 of the hydrophone section. The relationship between cable bulkhead 58 and boot assembly 66 is maintained by a split ring keeper 70 made up of two identical halves 72 as shown in FIGS. 3A, 3B, and 3C. FIG. 3A shows an inside view of the split ring keeper half 72. As can be seen, it has a small circumferential slot 74 designed to take the mating portion of cable bulkhead 58. It has a larger circumferential slot 76 to engage the mating portion of boot assembly 66. There are holes 78 for inserting screws or other means to join the two split ring keeper halves together over the juncture of boot assembly 66 and a cable bulkhead forming the end of a hydrophone cable section. FIG. 3C shows, from an end view, how the two halves are joined.

The method of disassembling and assembling boot assembly and inventive flexible electric cable should be apparent from the prior description. However, the joining means in holes 78 are removed from each of the split ring keepers 72 found at the end of boot assembly 66. The split ring keepers are removed from each end of boot assembly 66. Boot assembly 66 is then slid over cable bulkhead 58 thereby exposing stress members 60 and the connector. Stress members 60 are disconnected at stress member connections 62 and finally substrates 42 and 44 are pulled apart. Assembly is performed in the reverse order.

The present invention has been described and illustrated by means of specific embodiments, it is to be understood that numerous changes and modifications may be made therein without departing from the spirit and scope of the invention as defined in the following claims.

I claim as my invention:

1. An electrical connector comprising:

at least two flexible, magnetic and substantially electrically non-conductive substrates each having contact means mounted therein with contact faces on a first side of each of said substrates and adapted to meet in face to face contact when said substrates are juxtaposed, each said contact means adapted to accept at least one electrical wire on a second side of said substrates, and indexing means adapted to permit said at least two substrates to be juxtaposed in a predetermined position.

2. The connector of claim 1 wherein each of said substrate has attached thereto a tab for separating said substrate from juxtaposition with another.

3. The connector of claim 1 wherein said indexing means comprise indexing pins and holes.

4. The connector of claim 1 wherein said substrate is comprised of a thin rubbery material having magnetic particles dispersed therein.

5. The connector of claim 4 wherein said magnetic particles are dispersed in alternating rows of opposite magnetic orientation.

6. A watertight electrical connector assembly comprising:

a first and a second flexible, magnetic, and substantially electrically non-conductive substrate, each having contact means mounted therein with contact faces on a first side of each of said substrates and adapted to meet in face to face contact when said substrates are juxtaposed, electrical wires connected to each said contact means on a second side of each of said substrates, said wires from said first and second substrates forming a first and second bundle respectively, said first and second bundles fixably attached in first and second bulkheads, said bulkheads having sealing means disposed thereabout, boot means slidable over and extending from said first bulkhead to said second bulkhead and sealing against said sealing means disposed in said bulkheads, and first and second split ring keepers adapted to maintain said boot in sealing contact with said first and second bulkheads.

7. The connector assembly of claim 6 wherein each said substrate has attached thereto a tab for separating each said substrate from juxtaposition with another.

8. The connector assembly of claim 6 wherein said connector assembly further comprises indexing means adapted to permit said substrates to be juxtaposed in a predetermined position.

9. The connector assembly of claim 6 wherein said substrate is comprised of a thin rubbery material having magnetic particles dispersed therein.

10. The connector assembly of claim 9 wherein said magnetic particles are dispersed in alternating rows of opposite magnetic orientation.

11. The connector assembly of claim 6 wherein said sealing means comprise "O" rings.

12. The connector assembly of claim 6 wherein said assembly additionally comprises stress members extending at least from said first bulkhead to said second bulkhead.

13. A hydrophone streamer cable section comprising:

a flexible hydrophone housing containing at least one hydrophone, having two ends, and terminated by a bulkhead at each said end, electrical connector means mounted on each said bulkhead, each said connector means being comprised of a flexible, magnetic, and substantially electrically non-conductive substrate having contact means mounted therein with contact faces on a first side of said substrate, said contact means adapted to accept an electrical wire extending from said at least one hydrophone through a bulkhead to a second side of said substrate, and having indexing means to permit said connector means to be juxtaposed in a predetermined position to a similar connector.

14. The cable of claim 13 wherein each said substrate has attached thereto a tab for separating said substrate from juxtaposition with another.

15. The cable of claim 13 wherein said indexing means comprise indexing pins and holes.

16. The cable of claim 13 wherein said substrate is comprised of a thin rubbery material having magnetic particles dispersed therein.

17. The cable of claim 16 wherein said magnetic particles are dispersed in alternating rows of opposite magnetic orientation.

18. The cable of claim 13 wherein stress members extend from bulkhead to bulkhead and are fixedly attached thereto.

* * * * *